US006170129B1

(12) United States Patent
Pferdehirt

(10) Patent No.: US 6,170,129 B1
(45) Date of Patent: Jan. 9, 2001

(54) PRESS FASTENER

(75) Inventor: Thomas Pferdehirt, Wuppertal (DE)

(73) Assignee: YKK Europe Ltd., London (GB)

( * ) Notice: Under 35 U.S.C. 154(b), the term of this patent shall be extended for 0 days.

(21) Appl. No.: 09/276,205

(22) Filed: Mar. 25, 1999

(51) Int. Cl.[7] ..... A44B 1/38; A44B 17/00
(52) U.S. Cl. ..... 24/108; 24/113 MP; 24/114.4
(58) Field of Search ..... 24/108, 114.8, 24/114.4, 114.3, 113 MP

(56) References Cited

U.S. PATENT DOCUMENTS

| | | | | |
|---|---|---|---|---|
| 4,197,617 | * | 4/1980 | Appelt | 24/114.4 |
| 4,662,033 | * | 5/1987 | Wieland, Jr. et al. | 24/90 R |
| 5,014,400 | * | 5/1991 | Ban | 24/108 |
| 5,115,548 | * | 5/1992 | Nysten | 24/113 MP |
| 5,435,043 | * | 7/1995 | Ito et al. | 24/114.4 |
| 5,517,730 | * | 5/1996 | Ho | 24/108 |

FOREIGN PATENT DOCUMENTS

| | | | | |
|---|---|---|---|---|
| 1807760 | | 9/1970 | (DE) . | |
| 1944254 | | 3/1971 | (DE) . | |
| 3239445 | | 10/1983 | (DE) . | |
| 0401574 | | 12/1990 | (EP) . | |
| 3918375 | | 12/1990 | (DE) . | |
| 0606591 | * | 8/1948 | (GB) | 24/108 |

OTHER PUBLICATIONS

A. Raymond, Druckknopf– Und Metallwarenfabrik, "Druckknopf Aus Kunststoff", No. Prov. 918,486, Dec. 13, 1962.

* cited by examiner

*Primary Examiner*—Victor N. Sakran
(74) *Attorney, Agent, or Firm*—Friedrich Kueffner

(57) ABSTRACT

The press fastener comprises, in addition to a press fastener ball fixed to a first carrier web, a press fastener eyelet firmly connectable to a second carrier web by a rived shaft emanating from a rivet cap and passing through a central perforation. A simple construction involving low manufacturing cost, with high durability, i.e. a high number of closing and opening cycles, can be achieved if the press fastener eyelet is formed by a substantially annular, plastic moulding having the central perforation and comprising a round ball reception area and a temporarily widenable locking area which tapers towards the insertion end for the press fastener ball and extends roughly coaxially to the ball reception area. the said plastic body comprises a ring flange-like outer edge, to which is connected in axially displaced manner the central area having the central perforation. Moreover, an all-round groove increasing the resilient action of the locking area is provided in the ring flange-like outer edge of the plastic body radially outside the locking area, with the locking area being constructed polygonally. The plastic moulding may advantageously be moulded from POM (polyoxymethylene).

7 Claims, 4 Drawing Sheets

Fig.6
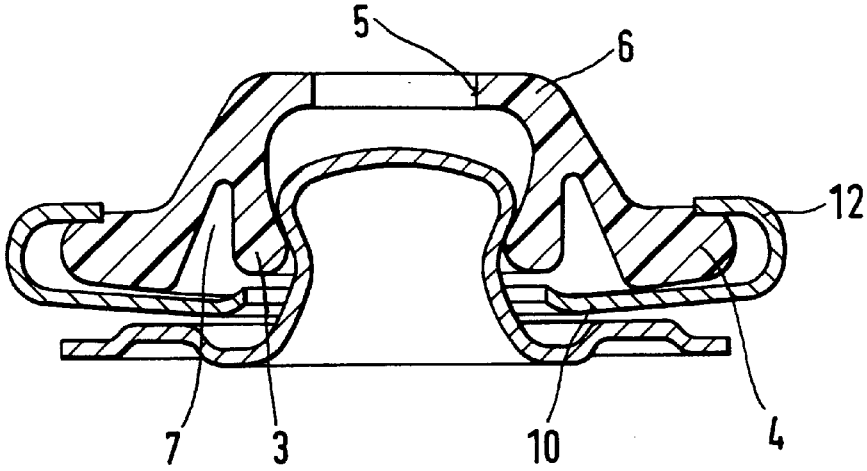
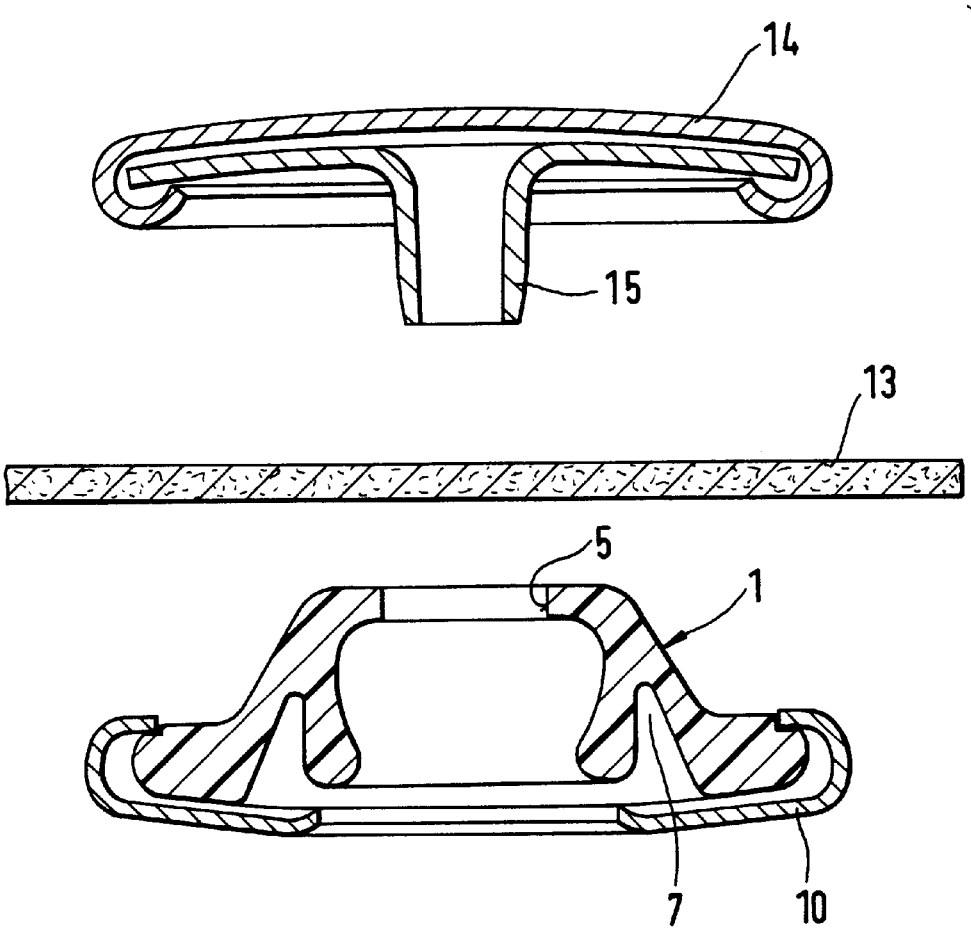
Fig.7

PRESS FASTENER

BACKGROUND OF THE INVENTION

1. Field of the Invention

This invention relates to a press fastener with a press fastener ball fixed to a first supporting web and a press fastener eyelet, which is firmly connectable to a second supporting web by means of a rivet shank, emanating from a rivet cap and passing through a central perforation.

2. Description of the Related Art

In a prior art press fastener of the present type (DE 39 18 375 A1, EP 0 401 574 A2 ), the press fastener eyelet comprises a plurality of elements, mostly punching sheet elements, mutually connected to form a unit and having a resilient member for holding the press fastener ball, said resilient member catching the ball head from the back. These press fasteners are intricate in structure, correspondingly costly with respect to their manufacture and, moreover, detrimentally allow for a low number of closing and opening cycles only.

According to another prior art embodiment, the press fastener eyelet is in the form of an eyelet pan made of sheet brass, the edge portion thereof bearing a widenable plastic ring in such a way that, when inserting the press fastener ball in the press fastener eyelet, the plastic ring, having been deformed temporarily, catches the press fastener ball from the back. Apart from the polygonal shape of the ring it is also known to insert a circular plastic ring having circumferentially radially projecting cams. Also in these embodiments the relatively complicated metal sheet eyelet pan is of functionally essential importance; besides, the desirable high number of closing and opening cycles cannot be achieved.

SUMMARY OF THE INVENTION

It is the object of the present invention to develop the press fastener of the type mentioned initially above so as to obtain a fastener that is low in price, while being simpler in construction, and that provides a high number of closing and opening cycles.

According to the present invention, this object is achieved essentially in that the press fastener eyelet comprises a substantially annular plastic moulding having said central perforation and which comprises a round ball reception area and a temporarily widenable locking area, tapering towards the insertion end for the press fastener ball and extending roughly coaxially thereto.

This functionally essential moulding can be manufactured by injection moulding of plastic material in an efficient, and thus inexpensive, manner. Besides, it is ensured that the locking area safely allows for very high closing and opening cycles.

BRIEF DESCRIPTION OF THE DRAWINGS

In a particularly advantageous embodiment, the plastic body comprises a ring flange-like outer edge, to which is connected in axially displaced manner the central area having the central perforation, and an all-round groove increasing the resilient action of the locking area is provided in the rang flange-like outer edge of the plastic body radially outside the locking area.

In this construction, the locking area may be of circular shape. According to a particularly advantageous modification, however, it is of polygonal shape, with the locking area having four circumferentially uniformly distributed projections on the radial inside.

As a material for producing the plastic body, polyamide or polyester may be used. However, as it has turned out, there may be achieved particularly high closing and opening cycles in the order of at least 50,000, without a remarkable change in energy to be spent, if the plastic moulding is moulded from POM (polyoxymethylene). Therefore, press fasteners having such a press fastener eyelet are particularly suitable for long-life commodity goods, such as money purses and are mainly used in leather industry.

A particularly attractive outer appearance of high durability may be obtained in spite of the before-mentioned high number of cycles if, on the side of the plastic body facing the insertion end, with the said plastic body is associated a metal cup with an opening only freeing the insertion end. This metal cup may be connected to the plastic body in any way desired. In a particularly advantageous modification, the metal cup is connected to the outer edge of the plastic body by inward beading of its outer edge.

Naturally, the press fastener eyelet, i.e. the plastic body and the metal cup, may be coloured with different colour shades according to requirements. A particularly attractive coloration can be obtained by colouring the metal cup as well as the plastic body with a gold shade.

DESCRIPTION OF THE PREFERRED EMBODIMENTS

Figure 1:
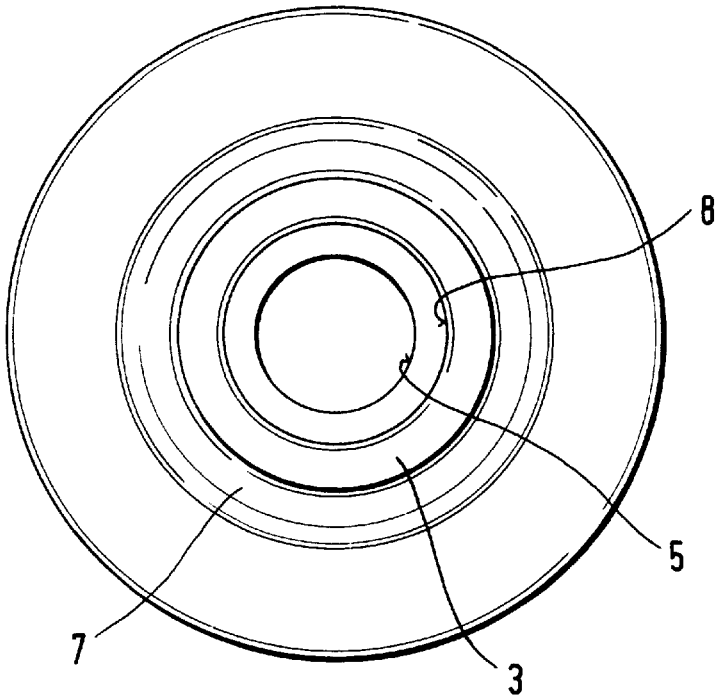
Figure 2:
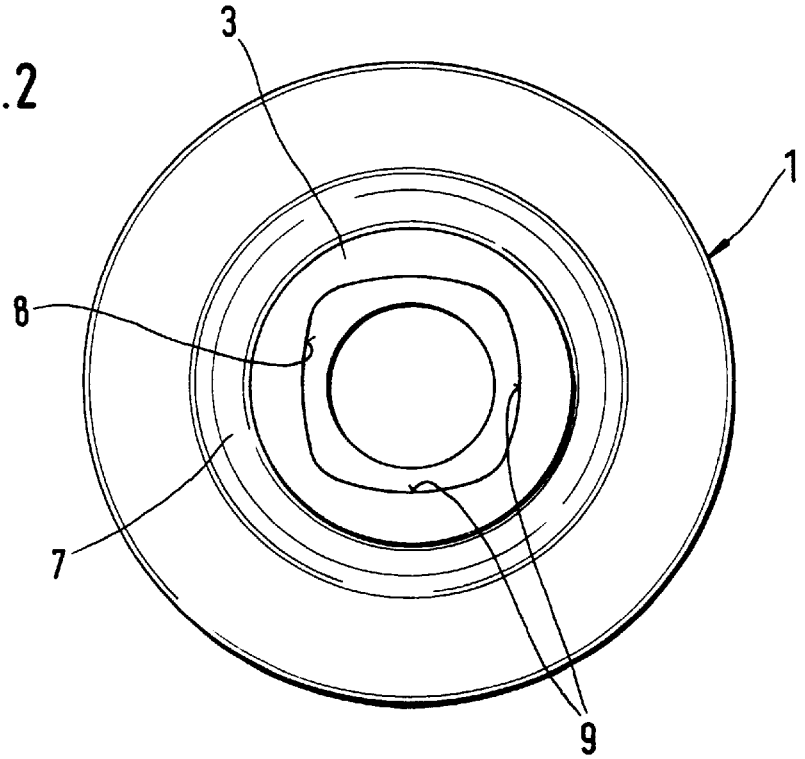
Figure 3:
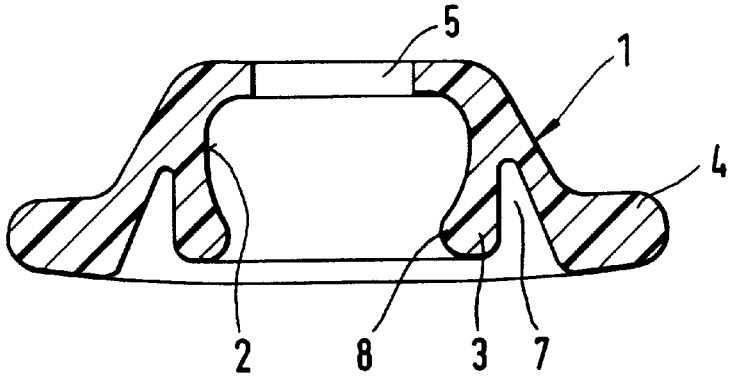
Figure 4:
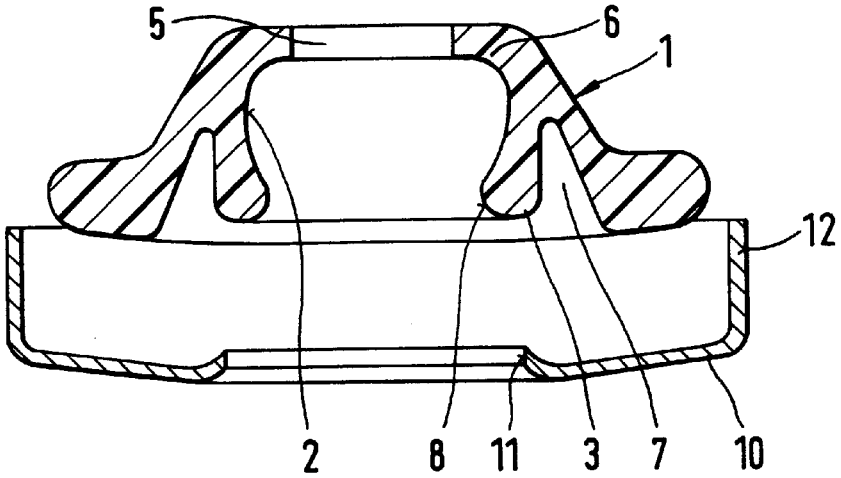
Figure 5:
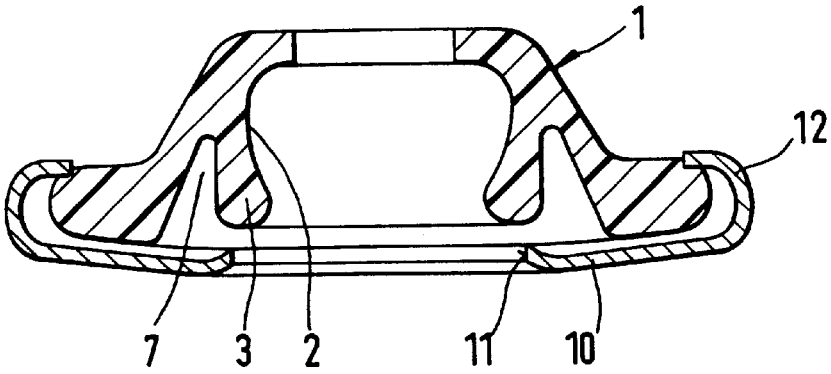
Figure 8:
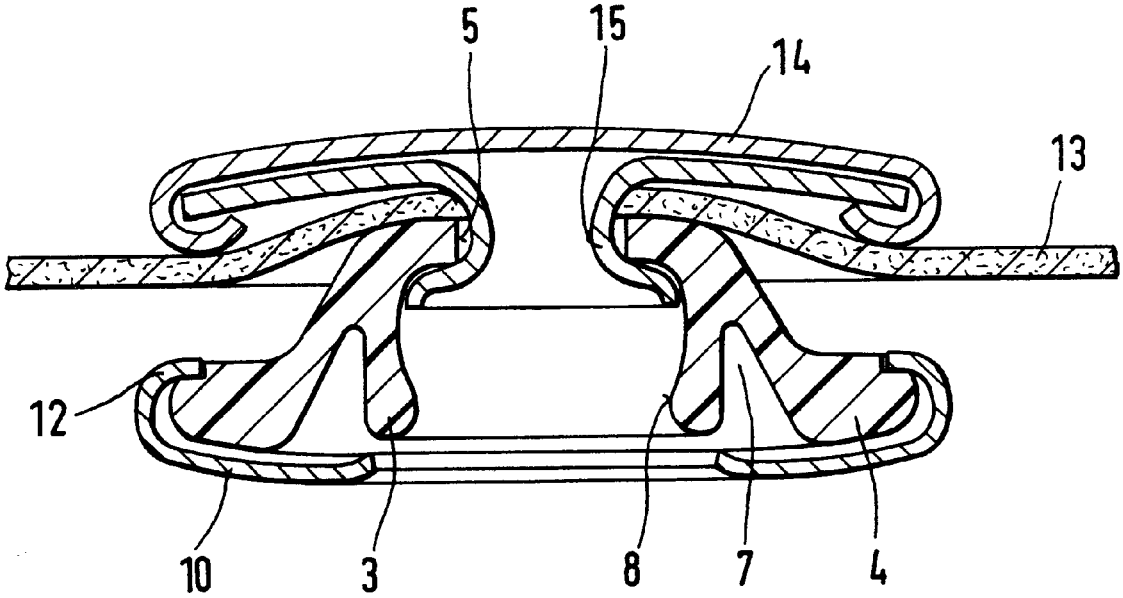

Further details, advantages and characteristic features will be apparent from the following description and the attached drawings, wherein FIGS. 1 and 2 are bottom plan views of two different embodiments of a plastic moulding forming a press fastener eyelet, FIG. 3 is a vertical sectional view of the moulding shown in FIGS. 1 and 2, FIG. 4 is a vertical sectional view of the moulding shown in FIG. 3, together with a metal cup also shown in a sectional view—before being connected—, FIG. 5 is a vertical sectional view of the moulding and the metal cup shown in FIG. 4—after having been connected—, FIG. 6 is a vertical sectional view to illustrate the moulding of FIG. 5 which has been fitted with a metal cup—after the ball member of the press fastener ball has been inserted—, FIG. 7 is a vertical sectional view of the moulding—metal cup unit before being fixed to a supporting web by means of a rivet comprising a rivet cap and a rivet shank, and FIG. 8 is a vertical sectional view of the individual elements illustrated in FIG. 7 after having been mutually connected and fixed to the carrier web.

As seen from the drawings, the illustrated press fastener eyelet essentially comprises an annular plastic moulding 1 having a round ball reception area 2 and a locking area 3 extending roughly coaxially thereto and tapering towards the insertion end for the press fastener ball (not shown), said locking area 3 being temporarily widenable. Said plastic body 1 comprises a ring flange-like outer edge 4 to which is connected in axially displaced manner the central area 6 having the central perforation 5. An all-round groove 7 increasing the resilient action of the locking area 3 is provided in the ring flange-like outer edge 4 of the plastic body 1 radially outside the locking area 3. Practically, said groove 7 is a so-called sparing allowing the locking area 3 which tapers towards the insertion end for the press fastener ball to deflect radially.

As shown in FIG. 1, the radially inner periphery 8 of the locking area 3 is of round shape, whereas in the embodiment of FIG. 2 it is polygonal. Further, as shown in FIG. 2, said locking area 3 has four projections 9 being circumferentially uniformly distributed.

Suitable materials for producing the plastic moulding 1 are polyamide or polyester. When using POM (polyoxymethylene), particularly high closing and opening cycles in the order of 50,000 or more may be achieved.

As illustrated in FIGS. 4 et seqs, with the plastic body 1 is associated, on the side facing the insertion end, a metal cup 10 having an opening 11 only freeing the insertion end. Said metal cup 10 can be connected, after insertion of the ring flange-like outer edge 4, with the outer edge of the plastic body 1 by inwardly beading its outer edge 12.

The metal cup 10 may advantageously be coloured with any required shades of colour, e.g. with a gold shade corresponding to the gold shade-coloured plastic body.

FIG. 7 shows a press fastener eyelet with all its elements prior to fixed it to a carrier web 13, such as a leather web or textile we. To fix the press fastener eyelet, which essentially is comprised of the annular plastic moulding 1 and the metal cup 10, to the carrier web 13, a cap rivet having a rivet cap 14 and a rivet shank 15 emanating from said cap is provided in known manner.

FIG. 8 shows the press fastener eyelet being fixed to the carrier web. As can be seen, the rivet cap 14 is fixedly connected to the carrier web 13, namely, by deformation of the rivet shank 15 passing not only through the carrier web but also through the central perforation 5 of the plastic body 1 and being widened inwardly and upwardly.

What is claimed is:

1. Press fastener with a press fastener ball fixed to a first supporting web and a press fastener eyelet (1, 10), which is firmly connectable to a second supporting web (13) by means of a rivet shank (15), passing through a central perforation and emanating from a rivet cap (14), the press fastener eyelet comprising a substantially annular, plastic moulding (1) having said central perforation (5) and further comprising a round ball reception area (2) and a temporarily widenable locking area, tapering towards the insertion end for the press fastener ball and extending roughly coaxially thereto, wherein the plastic body (1) comprises a ring flange-like outer edge (4), to which is connected in axially displaced manner the central area (6) having the central perforation (5), and that an all-round groove (7) increasing the resilient action of the locking area is provided in the ring flange-like outer edge (4) of the plastic body (1) radially outside the locking area (3).

2. Press fastener according to claim 1, wherein the locking area (3) is constructed polygonally.

3. Press fastener according to claim 2, wherein on the radial inside, the locking area (3) has four circumferentially uniformly distributed projections (8).

4. Press fastener according to claim 1, wherein the plastic moulding (1) is moulded from POM (polyoxymethylene).

5. Press fastener according to claim 1, on the side of the plastic body facing the insertion end, with the said plastic body (1) is associated a metal cup (10), with an opening (11) only freeing the insertion end.

6. Press fastener according to claim 5, wherein the metal cup (10) is connected to the outer edge (4) of the plastic body (1) by inward beading of its outer edge (12).

7. Press fastener according to claim 5, the metal cup (10), like the plastic body (1), is coloured e.g. with a gold shade.

* * * * *